US009229389B2

(12) United States Patent
Takagi et al.

(10) Patent No.: US 9,229,389 B2
(45) Date of Patent: Jan. 5, 2016

(54) FIXING DEVICE AND IMAGE FORMING APPARATUS

(71) Applicants: Hiromasa Takagi, Tokyo (JP); Kenji Ishii, Kanagawa (JP); Arinobu Yoshiura, Kanagawa (JP)

(72) Inventors: Hiromasa Takagi, Tokyo (JP); Kenji Ishii, Kanagawa (JP); Arinobu Yoshiura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/207,748

(22) Filed: Mar. 13, 2014

(65) Prior Publication Data

US 2014/0286684 A1 Sep. 25, 2014

(30) Foreign Application Priority Data

Mar. 25, 2013 (JP) ..... 2013-061720

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2082; G03G 2215/2016; G03G 15/2053; G03G 2215/2035
USPC ..... 399/329, 334
See application file for complete search history.

(56) References Cited

U.S. PATENT DOCUMENTS

| | | | | |
|---|---|---|---|---|
| 2002/0018109 | A1* | 2/2002 | Moriya et al. | 347/156 |
| 2007/0292175 | A1 | 12/2007 | Shinshi | |
| 2008/0298862 | A1 | 12/2008 | Shinshi | |
| 2009/0016792 | A1 | 1/2009 | Yamada et al. | |
| 2010/0092220 | A1 | 4/2010 | Hasegawa et al. | |
| 2011/0222888 | A1 | 9/2011 | Ikebuchi et al. | |

FOREIGN PATENT DOCUMENTS

| | | |
|---|---|---|
| JP | 6-003982 | 1/1994 |
| JP | 10-333463 | 12/1998 |
| JP | 2005-148618 | 6/2005 |
| JP | 2007-334205 | 12/2007 |
| JP | 2009-003410 | 1/2009 |
| JP | 2009-020158 | 1/2009 |
| JP | 2009-042305 | 2/2009 |
| JP | 2010-096782 | 4/2010 |
| JP | 2011-186275 | 9/2011 |

* cited by examiner

*Primary Examiner* — David Bolduc
*Assistant Examiner* — Barnabas Fekete
(74) *Attorney, Agent, or Firm* — Harness, Dickey & Pierce, P.L.C.

(57) ABSTRACT

A fixing device includes an endless belt, a heater disposed opposite the endless belt to heat the endless belt, and a pressing rotary body contacting an outer circumferential surface of the endless belt. A nip formation pad presses against the pressing rotary body via the endless belt to form a fixing nip between the endless belt and the pressing rotary body, through which a recording medium is conveyed. The nip formation pad includes a nip face disposed opposite the endless belt. The nip face includes a first region having an increased thermal conductivity and a second region having a decreased thermal conductivity and being adjacent to the first region in an axial direction of the endless belt.

15 Claims, 9 Drawing Sheets

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-061720, filed on Mar. 25, 2013, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such image forming apparatuses are requested to print quickly while saving energy. To address this request, the fixing device that consumes energy may employ an endless belt having a decreased heat capacity that facilitates quick heating of the endless belt so as to shorten a warm-up time taken for the fixing device to be heated to a desired fixing temperature to fix the toner image on the recording medium and a first print time taken to output the recording medium bearing the fixed toner image onto an outside of the image forming apparatus after the image forming apparatus receives a print job.

Additionally, since the image forming apparatuses are requested to print quickly, an increased number of recording media is conveyed through the fixing device per minute. Accordingly, the fixing device requires an increased amount of heat to be supplied to the recording media. Consequently, upon start of a print job for printing on a plurality of recording media continuously, the fixing device may suffer from shortage of heat.

To address those requests, a fixing device 20R1 employing an endless belt is proposed as shown in FIG. 1. As shown in FIG. 1, the fixing device 20R1 includes an endless belt 21R rotatable counterclockwise in FIG. 1; a tubular, metal thermal conductor 22R stationarily disposed inside the endless belt 21R to guide the endless belt 21R; a heater 23R situated inside the metal thermal conductor 22R to heat the endless belt 21R through the metal thermal conductor 22R; and a pressure roller 24R pressed against the metal thermal conductor 22R via the endless belt 21R to form a fixing nip N between the endless belt 21R and the pressure roller 24R. As the pressure roller 24R rotates clockwise in FIG. 1, the endless belt 21R rotates counterclockwise in FIG. 1 in accordance with rotation of the pressure roller 24R. The metal thermal conductor 22R heated by the heater 23R in turn heats the endless belt 21R entirely, shortening the first print time and overcoming shortage of heat.

In order to shorten the first print time further while saving energy, a fixing device 20R2 without the metal thermal conductor 22R is proposed as shown in FIG. 2. The fixing device 20R2 includes a nip formation plate 126R disposed inside the endless belt 21R instead of the metal thermal conductor 22R depicted in FIG. 1. Since the nip formation plate 126R supported by a support 127R is disposed opposite the pressure roller 24R via the endless belt 21R at the fixing nip N, the heater 23R heats the endless belt 21R directly in a circumferential span of the endless belt 21R where the nip formation plate 126R is not interposed between the heater 23R and the endless belt 21R, thus heating the endless belt 21R effectively and therefore shortening the first print time while saving energy.

The heater 23R spans a width of a maximum recording medium in an axial direction of the endless belt 21R. Accordingly, after a plurality of small recording media is conveyed over the endless belt 21R continuously, a non-conveyance span situated at both lateral ends of the endless belt 21R in the axial direction thereof where the small recording media are not conveyed may overheat because the small recording media do not draw heat from both lateral ends of the endless belt 21R. Consequently, both lateral ends of the endless belt 21R and the pressure roller 24R contacting the endless belt 21R may be heated to a temperature high than their heat resistant temperature. To address this circumstance, it may be necessary to suppress heating of the non-conveyance span of the endless belt 21R to protect the endless belt 21R and the pressure roller 24R, degrading productivity of the fixing devices 20R1 and 20R2. Since the thermal capacity of the endless belt 21R is decreased to shorten the warm-up time while saving energy, the endless belt 21R is susceptible to overheating.

SUMMARY

At least one embodiment provides a novel fixing device that includes an endless belt, a heater disposed opposite the endless belt to heat the endless belt, and a pressing rotary body contacting an outer circumferential surface of the endless belt. A nip formation pad presses against the pressing rotary body via the endless belt to form a fixing nip between the endless belt and the pressing rotary body, through which a recording medium is conveyed. The nip formation pad includes a nip face disposed opposite the endless belt. The nip face includes a first region having an increased thermal conductivity and a second region having a decreased thermal conductivity and being adjacent to the first region in an axial direction of the endless belt.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
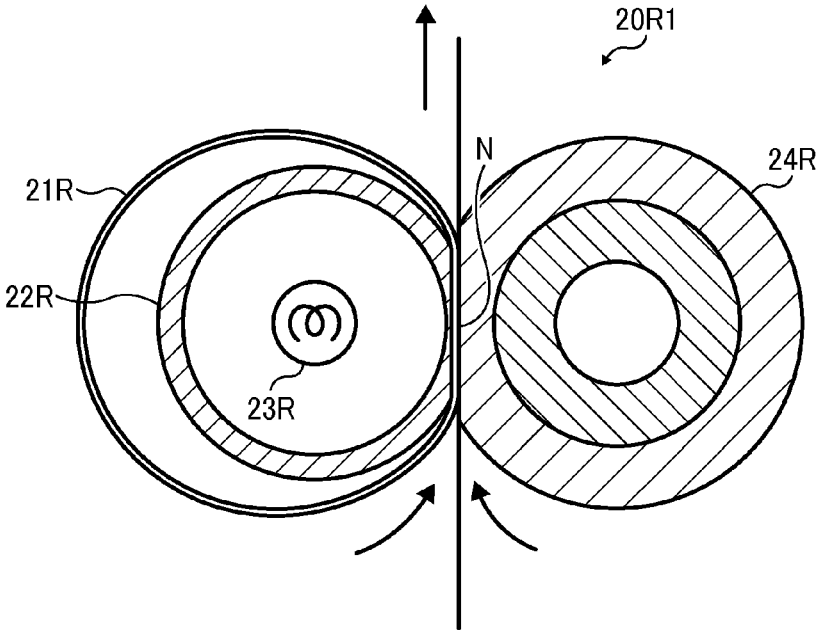
FIG. 1 RELATED ART
FIG. 1 is a vertical sectional view of a related-art fixing device.
Figure 2:
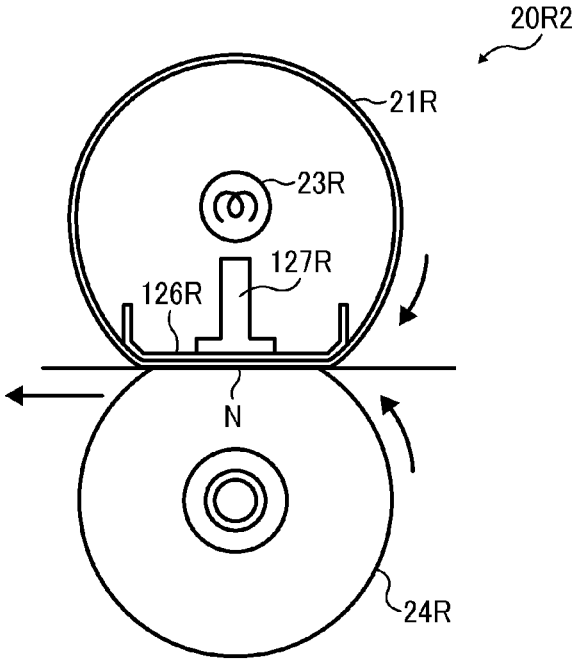
FIG. 2 RELATED ART
FIG. 2 is a vertical sectional view of another related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
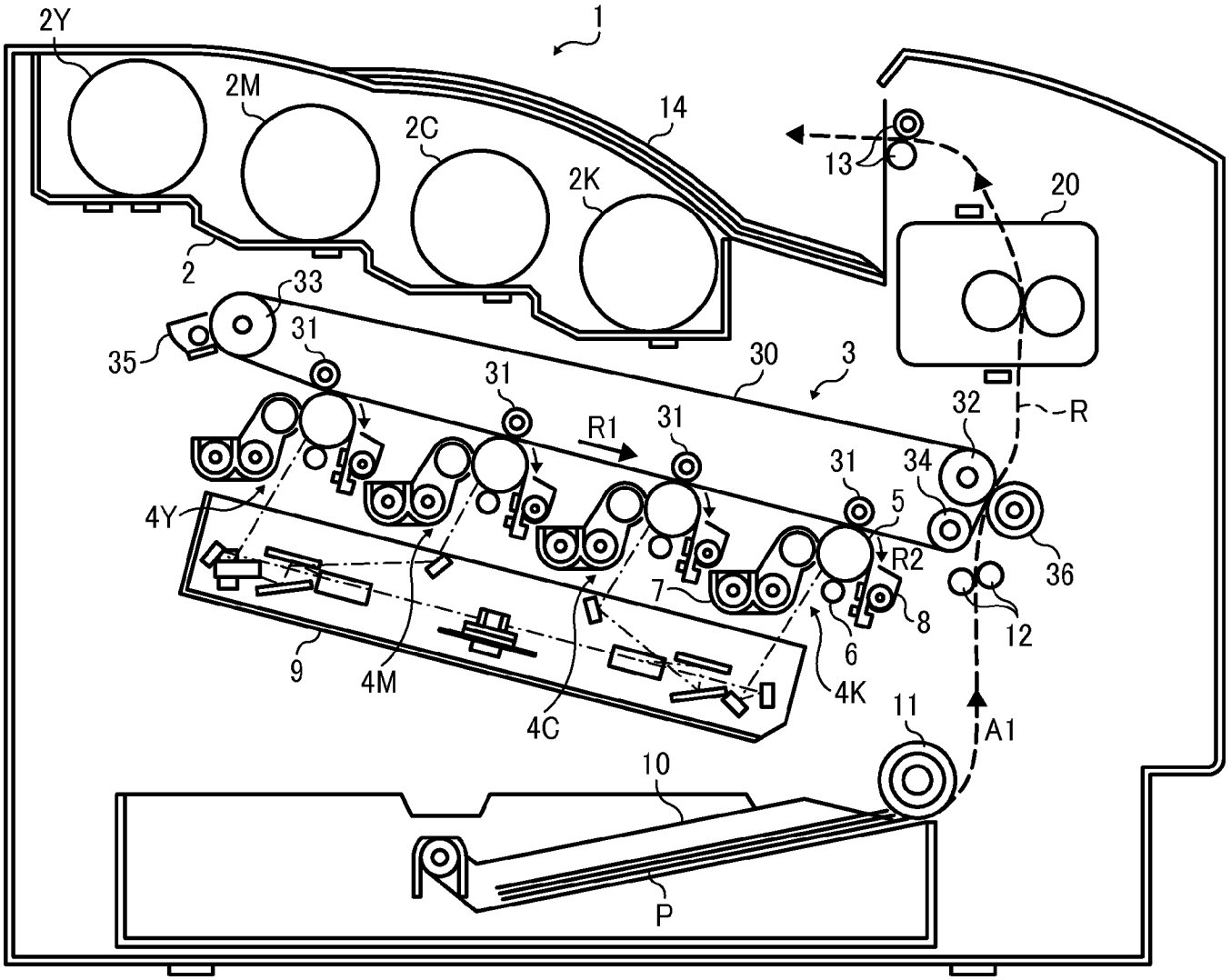
FIG. 3 is a schematic vertical sectional view of an image forming apparatus according to an example embodiment of the present invention.

Referring now to the drawings, wherein like reference numerals designate identical or corresponding parts throughout the several views, particularly to FIG. 3, an image forming apparatus 1 according to an example embodiment is explained.

FIG. 3 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color laser printer that forms color and monochrome toner images on recording media by electrophotography. Alternatively, the image forming apparatus 1 may form an image by other methods.

As shown in FIG. 3, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure. Hence, the following describes a configuration of the image forming device 4K that forms a black toner image. Reference numerals are omitted for components of the image forming devices 4Y, 4M, and 4C.

For example, the image forming device 4K includes a drum-shaped photoconductor 5 serving as an image carrier that carries an electrostatic latent image and a resultant toner image; a charger 6 that charges an outer circumferential surface of the photoconductor 5; a development device 7 that supplies black toner to the electrostatic latent image formed on the outer circumferential surface of the photoconductor 5, thus visualizing the electrostatic latent image into a black toner image with the black toner; and a cleaner 8 that cleans the outer circumferential surface of the photoconductor 5.

Below the image forming devices 4Y, 4M, 4C, and 4K is an exposure device 9 that exposes the outer circumferential surface of the respective photoconductors 5 of the image forming devices 4Y, 4M, 4C, and 4K with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 3, the secondary transfer backup roller 32 rotates the intermediate transfer belt 30 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto so that the primary transfer rollers 31 primarily transfer the yellow, magenta, cyan, and black toner images formed on the photoconductors 5 onto the intermediate transfer belt 30, thus forming a color toner image thereon.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto so that the secondary transfer roller 36 secondarily transfers the color toner image formed on the intermediate transfer belt 30 onto a recording medium P.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle container 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, OHP (overhead projector) transparencies, OHP film sheets, and the like. Optionally, a bypass tray may be attached to the image forming apparatus 1 that loads special paper such as thick paper, postcards, envelopes, thin paper, coated paper, art paper, tracing paper, OHP transparencies, OHP film sheets, and the like as well as plain paper.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 serving as a timing roller located below the secondary transfer nip formed between the secondary transfer roller 36 and the intermediate transfer belt 30, that is, upstream from the secondary transfer nip in a recording medium conveyance direction A1. The registration roller pair 12 feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes the color toner image transferred from the intermediate transfer belt 30 onto the recording medium P thereon. The conveyance path R is further provided with the output roller pair 13 located above the fixing device 20, that is, downstream from the fixing device 20 in the recording medium conveyance direction A1. The output roller pair 13 discharges the recording medium P bearing the fixed color toner image onto the outside of the image forming apparatus 1, that is, an output tray 14 disposed atop the image forming apparatus 1. The output tray 14 stocks the recording media P discharged by the output roller pair 13.

With reference to FIG. 3, a description is provided of an image forming operation of the image forming apparatus 1 having the structure described above to form a color toner image on a recording medium P.

As a print job starts, a driver drives and rotates the photoconductor 5 of the respective image forming devices 4Y, 4M, 4C, and 4K clockwise in FIG. 3 in a rotation direction R2. The chargers 6 uniformly charge the outer circumferential surface of the photoconductors 5 at a predetermined polarity, respectively. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 3, rotating the intermediate transfer belt 30 in the rotation direction R1 by friction therebetween. A power supply applies a constant voltage or a constant current control voltage having a polarity opposite a polarity of the toner to the primary transfer rollers 31. Thus, a transfer electric field is created at the primary transfer nips formed between the primary transfer rollers 31 and the photoconductors 5, respectively.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. The registration roller pair 12 feeds the recording medium P to the secondary transfer nip formed between the secondary transfer roller 36 and the intermediate transfer belt 30 at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

When the color toner image formed on the intermediate transfer belt 30 reaches the secondary transfer nip in accordance with rotation of the intermediate transfer belt 30, the color toner image is secondarily transferred from the intermediate transfer belt 30 onto the recording medium P by the transfer electric field created at the secondary transfer nip. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 4:
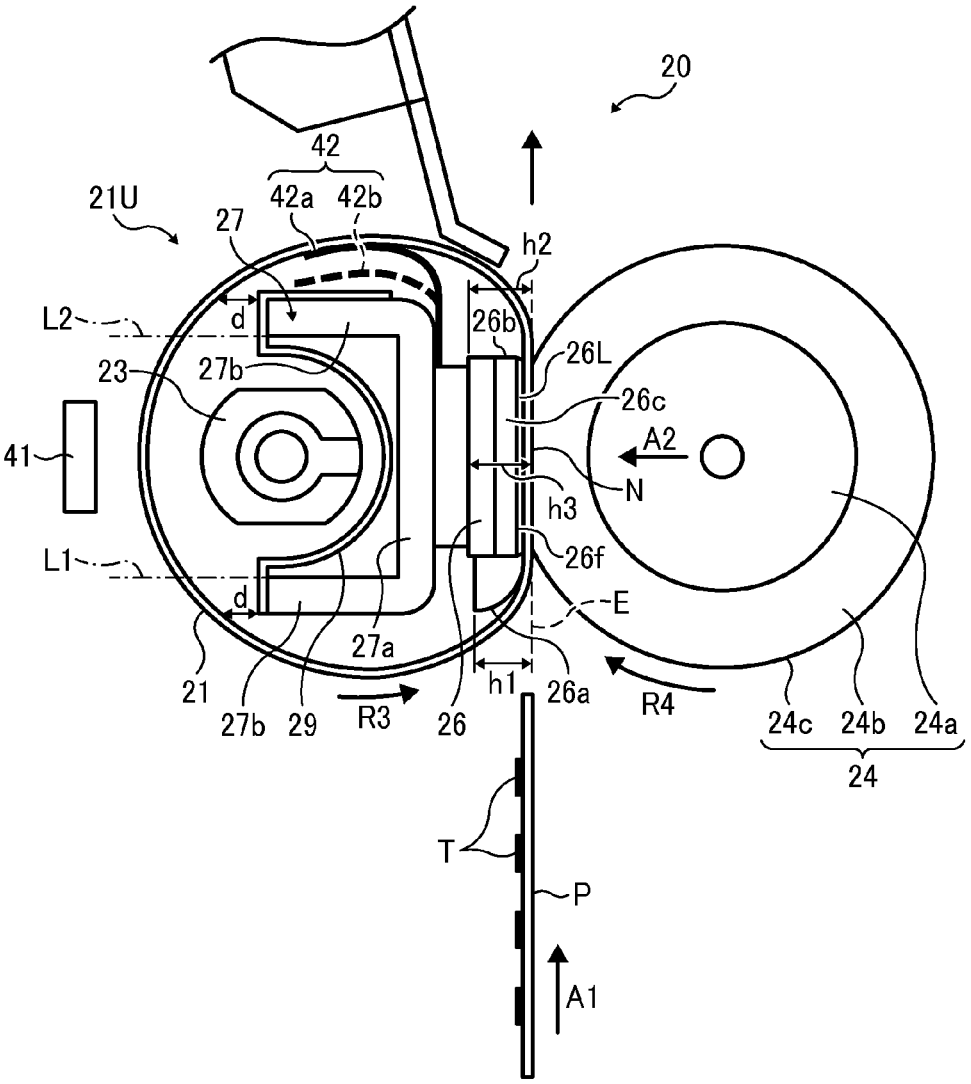
FIG. 4 is a vertical sectional view of a fixing device incorporated in the image forming apparatus shown in FIG. 3.

With reference to FIG. 4, a description is provided of a construction of the fixing device 20 incorporated in the image forming apparatus 1 described above.

FIG. 4 is a vertical sectional view of the fixing device 20. As shown in FIG. 4, the fixing device 20 (e.g., a fuser) includes a fixing belt 21 serving as a fixing rotary body or a flexible endless belt formed into a loop and rotatable in a rotation direction R3; a pressure roller 24 serving as a pressing rotary body contacting an outer circumferential surface of the fixing belt 21 and rotatable in a rotation direction R4 counter to the rotation direction R3 of the fixing belt 21; a halogen heater 23 serving as a heater disposed inside the loop formed by the fixing belt 21 and heating the fixing belt 21; a nip formation pad 26 disposed inside the loop formed by the fixing belt 21 and pressing against the pressure roller 24 via the fixing belt 21 to form a fixing nip N between the fixing belt 21 and the pressure roller 24; a support 27 disposed inside the loop formed by the fixing belt 21 and contacting and supporting the nip formation pad 26; a reflector 29 disposed inside the loop formed by the fixing belt 21 and reflecting light radiated from the halogen heater 23 toward the fixing belt 21; a supplemental thermal conductor 42 disposed inside the loop formed by the fixing belt 21 and in contact with the support 27; and a temperature sensor 41 disposed opposite the outer circumferential surface of the fixing belt 21 to detect the temperature of the fixing belt 21.

The fixing belt 21 and the components disposed inside the loop formed by the fixing belt 21, that is, the halogen heater 23, the nip formation pad 26, the support 27, the reflector 29, and the supplemental thermal conductor 42, may constitute a belt unit 21U separably coupled with the pressure roller 24.

A detailed description is now given of a configuration of the halogen heater 23.

The halogen heater 23 is disposed opposite an inner circumferential surface of the fixing belt 21 to heat the fixing belt 21 directly. Both lateral ends of the halogen heater 23 in a longitudinal direction thereof parallel to an axial direction of the fixing belt 21 are mounted on side plates of the fixing device 20, respectively. A controller (e.g., a processor), that is, a central processing unit (CPU) provided with a random-access memory (RAM) and a read-only memory (ROM), for example, is provided in the image forming apparatus 1 depicted in FIG. 3 or the fixing device 20 and operatively connected to the halogen heater 23 and the temperature sensor 41. The controller controls the halogen heater 23 based on the temperature of the outer circumferential surface of the fixing belt 21 detected by the temperature sensor 41 so as to adjust the temperature of the fixing belt 21 to a desired fixing temperature. According to this example embodiment, the halogen heater 23 is used as a heater. Alternatively, an induction heater (IH), a resistance heat generator, a carbon heater, or the like may be used as a heater for heating the fixing belt 21. Further, the heater may be disposed opposite the outer circumferential surface of the fixing belt 21.

A detailed description is now given of a construction of the fixing belt 21.

The fixing belt 21 is a thin, flexible endless belt or film constructed of a base layer and a release layer constituting the outer circumferential surface of the fixing belt 21. The base layer is made of metal such as nickel and SUS stainless steel or resin such as polyimide The release layer constituting the outer circumferential surface of the fixing belt 21 is made of tetrafluoroethylene-perfluoroalkylvinylether copolymer (PFA), polytetrafluoroethylene (PTFE), or the like that facilitates separation of toner from the fixing belt 21 and prevents adhesion of toner to the fixing belt 21.

An elastic layer made of silicone rubber or the like may be interposed between the base layer and the release layer. If the fixing belt 21 does not incorporate the elastic layer, the fixing belt 21 has a decreased thermal capacity that improves fixing performance of being heated to a desired fixing temperature quickly. However, as the pressure roller 24 and the fixing belt 21 sandwich and press a toner image T on a recording medium P passing through the fixing nip N, slight surface asperities of the fixing belt 21 may be transferred onto the toner image T on the recording medium P, causing variation in gloss of the solid toner image that appears as an orange peel image. To address this circumstance, the elastic layer has a thickness not smaller than about 100 micrometers. As the elastic layer deforms, the elastic layer absorbs slight surface asperities of the fixing belt 21, preventing formation of the orange peel image.

The fixing belt 21 is designed to be thin and have a reduced loop diameter so as to decrease the thermal capacity thereof. For example, the fixing belt 21 has a total thickness not greater than about 1 mm and a loop diameter in a range of from about 20 mm to about 40 mm. The base layer has a thickness in a range of from about 20 micrometers to about 50 micrometers; the elastic layer has a thickness in a range of from about 100 micrometers to about 300 micrometers; and the release layer has a thickness in a range of from about 10 micrometers to about 50 micrometers. In order to decrease the thermal capacity of the fixing belt 21 further, the fixing belt 21 may have a total thickness not greater than about 0.20 mm, preferably not greater than about 0.16 mm, and a loop diameter of not greater than about 30 mm.

A detailed description is now given of a construction of the pressure roller 24.

The pressure roller 24 is constructed of a core metal 24*a*, an elastic layer 24*b* coating the core metal 24*a* and made of silicone rubber or the like, and a surface release layer 24*c* coating the elastic layer 24*b* and made of PFA, PTFE, or the like that facilitates separation of the recording medium P from the pressure roller 24. As the pressure roller 24 receives a driving force transmitted from a driver (e.g., a motor) provided in the image forming apparatus 1 depicted in FIG. 3 through a gear train, the pressure roller 24 rotates in the rotation direction R4. Alternatively, the driver may also be connected to the fixing belt 21 to drive and rotate the fixing belt 21.

The pressure roller 24 is pressed against the fixing belt 21 by a spring or the like. Accordingly, the elastic layer 24*b* of the pressure roller 24 is pressed and deformed by the spring, producing the fixing nip N having a desired length in the recording medium conveyance direction A1. According to this example embodiment, the pressure roller 24 is a solid roller. Alternatively, the pressure roller 24 may be a hollow roller. In this case, a heater such a halogen heater may be situated inside the hollow roller. The elastic layer 24*b* may be made of solid rubber. Alternatively, if no heater is disposed inside the pressure roller 24, the elastic layer 24*b* may be made of sponge rubber. The sponge rubber is more preferable than the solid rubber because it has an increased insulation that draws less heat from the fixing belt 21. The pressure roller 24 has a diameter in a range of from about 20 mm to about 40 mm so that the loop diameter of the fixing belt 21 is equivalent to the diameter of the pressure roller 24. However, the loop diameter of the fixing belt 21 and the diameter of the pressure roller 24 are not limited to the above.

A detailed description is now given of a configuration of the nip formation pad 26.

The nip formation pad 26, disposed opposite the inner circumferential surface of the fixing belt 21, presses against the pressure roller 24 via the fixing belt 21 to form the fixing nip N between the fixing belt 21 and the pressure roller 24. The inner circumferential surface of the fixing belt 21 slides over the nip formation pad 26 indirectly via a slide sheet 26L a low-friction sheet) sandwiched between the fixing belt 21 and the nip formation pad 26. As the fixing belt 21 rotates in the rotation direction R3, it slides over the slide sheet 26L with decreased friction therebetween, decreasing a driving torque exerted on the fixing belt 21 and frictional load imposed on the fixing belt 21. For example, the slide sheet 26L is produced by weaving PTFE fiber. Asperities of the PTFE fiber decrease an area where the PTFE fiber contacts the fixing belt 21, decreasing frictional resistance between the PTFE fiber and the fixing belt 21 further. Additionally, the slide sheet 26L made of the PTFE fiber retains a lubricant such as silicone oil, silicone grease, and fluoro grease for an extended period of time, thus decreasing frictional resistance between the slide sheet 26L and the fixing belt 21 with the lubricant over time.

A longitudinal direction of the nip formation pad 26 is parallel to the axial direction of the fixing belt 21 or the pressure roller 24. The nip formation pad 26 has a thickness in a range of from about 1 mm to about 10 mm to increase a cross-sectional area thereof, thus increasing an amount of heat transmitted through the nip formation pad 26 in the longitudinal direction thereof. The nip formation pad 26 is made of a plurality of materials. One of those materials is heat-resistant resin resistant against temperatures not smaller than about 200 degrees centigrade, which allows the nip formation pad 26 to endure pressure from the pressure roller 24 even in a fixing temperature range to fix the toner image T on the recording medium P. For example, the heat-resistant resin may be polyether sulfone (PES), polyphenylene sulfide (PPS), liquid crystal polymer (LCP), polyether nitrile (PEN), polyamideimide (PAT), polyetheretherketone (PEEK), or the like.

Another one of the materials for the nip formation pad 26 is a heat-resistant, conductive material defining a thermal conductor. For example, the heat-resistant, conductive material may be carbon nanotube having thermal conductivity in a range of from about 3,000 W/mK to about 5,500 W/mK, graphite sheet having thermal conductivity in a range of from about 700 W/mK to about 1,750 W/mK, silver having thermal conductivity of about 420 W/mK, copper having thermal conductivity of about 398 W/mK, aluminum having thermal conductivity of about 236 W/mK, or the like.

Accordingly, a nip face 26*f* of the nip formation pad 26 disposed opposite the fixing nip N over which the fixing belt 21 slides exposes a heat-resistant resin portion made of the heat-resistant resin and a thermal conductor portion made of the thermal conductor. In order to conduct heat evenly throughout the nip formation pad 26, the nip face 26*f* of the nip formation pad 26 may be constructed of a plurality of thermal conductor portions without the heat-resistant resin portion. Further, a surface roughness Ra of the nip face 26*f* of the nip formation pad 26 may not be greater than a roughness of the inner circumferential surface of the fixing belt 21, not greater than 6.3, for example, to facilitate adhesion of the fixing belt 21 to the nip formation pad 26. It is because, if surface asperities of the nip face 26*f* of the nip formation pad 26 produce a space between the nip formation pad 26 and the fixing belt 21, air contained in the space may serve as an insulating layer that degrades heat conduction between the fixing belt 21 and the nip formation pad 26 substantially. Alternatively, the nip face 26*f* of the nip formation pad 26 may be coated with a fluoroplastic layer made of PFA, PTFE, ethylene tetrafluoroethylene (ETFE), or the like and having a thickness in a range of from about 5 micrometers to about 50 micrometers, which facilitates sliding of the fixing belt 21 over the nip face 26*f* of the nip formation pad 26. However, since thermal conductivity of fluoroplastic is smaller than that of the thermal conductor, whether or not to employ the fluoroplastic layer and the thickness of the fluoroplastic layer are determined properly. A detailed description of the nip face 26*f* of the nip formation pad 26 is deferred.

A detailed description is now given of a configuration of the support 27. The support 27 is a stay disposed opposite the inner circumferential surface of the fixing belt 21 to mount and support the nip formation pad 26. The support 27 prevents the nip formation pad 26 from being bent by pressure from the pressure roller 24, securing the desired length of the fixing nip N in the recording medium conveyance direction A1 evenly throughout the longitudinal direction of the nip formation pad 26. Both lateral ends of the support 27 in a longitudinal direction thereof parallel to the axial direction of the fixing belt 21 are mounted on and supported by belt holders and slip rings described below. Thus, the support 27 is positioned inside the fixing device 20. For example, the support 27 is made of metal having an increased mechanical strength, such as stainless steel and iron, to prevent bending of the nip formation pad 26. Alternatively, the support 27 may be made of resin.

A detailed description is now given of a configuration of the supplemental thermal conductor 42.

The supplemental thermal conductor 42 may be attached to the support 27. FIG. 4 illustrates the supplemental thermal conductor 42 in contact with the fixing belt 21 as a supplemental thermal conductor 42*a* indicated by the solid line and the supplemental thermal conductor 42 in isolation from the fixing belt 21 as a supplemental thermal conductor 42*b* indicated by the dotted line. One end, that is, a fixed end, of the supplemental thermal conductor 42 is in constant contact with the support 27 to conduct heat from the support 27 to the fixing belt 21. Another end, that is, a free end, of the supplemental thermal conductor 42 is separably in contact with the inner circumferential surface of the fixing belt 21. Since the supplemental thermal conductor 42 contacts the inner circumferential surface of the fixing belt 21, the supplemental thermal conductor 42 does not damage the outer circumferential surface of the fixing belt 21, preventing formation of a faulty toner image on the recording medium P. The supplemental thermal conductor 42 includes a soft sheet that reduces load imposed on the fixing belt 21 sliding over the supplemental thermal conductor 42, preventing breakage of the fixing belt 21. In order to reduce load imposed on the fixing belt 21 as it slides over the supplemental thermal conductor 42 further, a surface of the supplemental thermal conductor 42 may be coated with a fluoroplastic layer made of PFA, PTFE, ETFE, or the like and having a thickness in a range of from about 5 micrometers to about 50 micrometers. Alternatively, the surface of the supplemental thermal conductor 42 may be applied with a lubricant such as silicone oil, silicone grease, and fluoro grease.

A detailed description is now given of a configuration of the reflector 29.

The reflector 29 is interposed between the halogen heater 23 and the support 27 to reflect light radiated from the halogen heater 23 to the fixing belt 21, preventing the halogen heater 23 from heating the support 27 unnecessarily and therefore saving energy. The reflector 29 made of metal having an increased melting point is mounted on the support 27. The reflector 29 reflects light radiated from the halogen heater 23 toward the support 27 to the fixing belt 21, increasing an amount of heat reaching the fixing belt 21 and thus heating the fixing belt 21 effectively. Alternatively, instead of mounting the reflector 29, a reflection face of the support 27 may be treated with insulation or mirror finished to attain the advantages described above. The reflector 29 or the reflection face of the support 27 that reflects light radiated from the halogen heater 23 has a reflectance not smaller than about 90 percent.

Figure 5A:
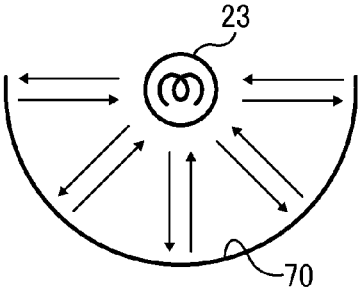
FIG. 5A is a schematic vertical sectional view of a halogen heater and a comparative reflection face of a support or a reflector installable in the fixing device shown in FIG. 4.
Figure 5B:
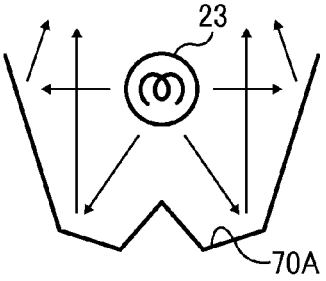
FIG. 5B is a schematic vertical sectional view of the halogen heater and another comparative reflection face of the support or the reflector installable in the fixing device shown in FIG. 4.

The reflector 29 or the reflection face of the support 27 is angled relative to the halogen heater 23 to allow light reflected by the reflector 29 or the reflection face of the support 27 to heat the fixing belt 21 more effectively. FIG. 5A is a schematic vertical sectional view of the halogen heater 23 and a reflection face 70 of the support 27 or the reflector 29. FIG. 5B is a schematic vertical sectional view of the halogen heater 23 and a reflection face 70A of the support 27 or the reflector 29. As shown in FIG. 5A, the reflection face 70 contoured concentrically with respect to the halogen heater 23 reflects light toward the halogen heater 23, rendering the light to heat the fixing belt 21 ineffectively. Conversely, as shown in FIG. 5B, the reflection face 70A contoured partially or entirely to reflect light from the halogen heater 23 toward targets including the fixing belt 21 other than the halogen heater 23 reflects light toward the halogen heater 23 in a decreased amount, allowing the light to heat the fixing belt 21 effectively.

Figure 6A:
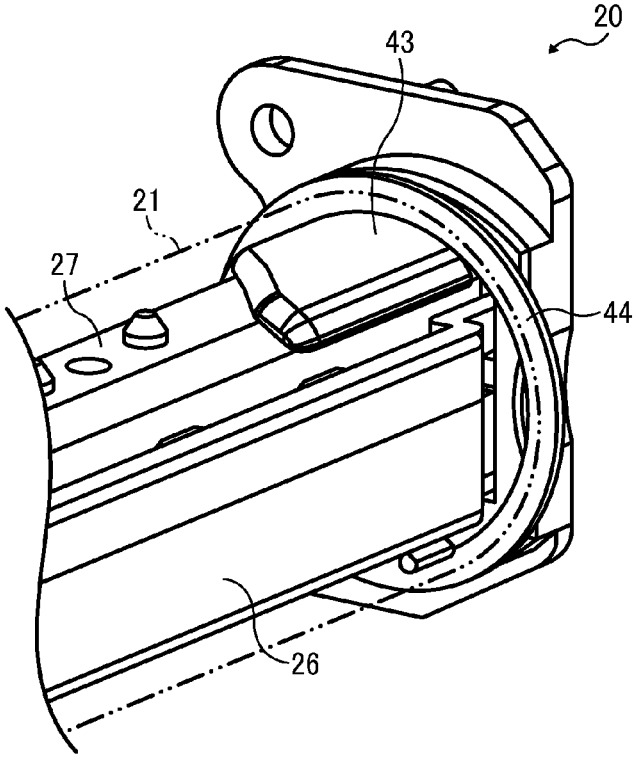
FIG. 6A is a partial perspective view of the fixing device shown in FIG. 4 illustrating one lateral end of a fixing belt in an axial direction thereof.
Figure 6B:
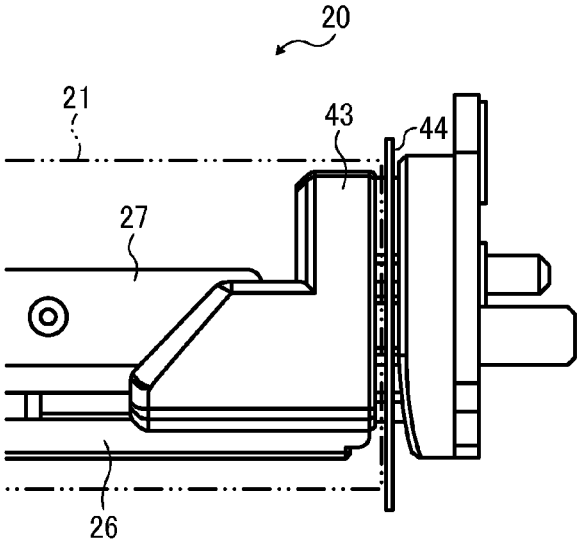
FIG. 6B is a partial plan view of the fixing device shown in FIG. 6A illustrating one lateral end of the fixing belt in the axial direction thereof.
Figure 6C:
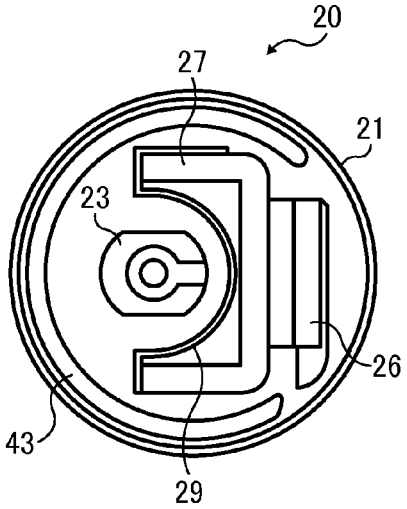
FIG. 6C is a partial vertical sectional view of the fixing device shown in FIG. 6A illustrating one lateral end of the fixing belt in the axial direction thereof.

With reference to FIGS. 6A, 6B, and 6C, a description is provided of a configuration of a lateral end of the fixing belt 21 in the axial direction thereof.

FIG. 6A is a partial perspective view of the fixing device 20 illustrating one lateral end of the fixing belt 21 in the axial direction thereof. FIG. 6B is a partial plan view of the fixing device 20 illustrating one lateral end of the fixing belt 21 in the axial direction thereof. FIG. 6C is a partial vertical sectional view of the fixing device 20 illustrating one lateral end of the fixing belt 21 in the axial direction thereof. Although not shown, another lateral end of the fixing belt 21 in the axial direction thereof has the identical configuration shown in FIGS. 6A to 6C. Hence, the following describes the configuration of one lateral end of the fixing belt 21 in the axial direction thereof with reference to FIGS. 6A to 6C.

As shown in FIGS. 6A and 6B, a belt holder 43 is inserted into each lateral end of the fixing belt 21 in the axial direction thereof to rotatably support each lateral end of the fixing belt 21 in the axial direction thereof. As shown FIG. 6C, the belt holder 43 is formed into a C-shape in cross-section to create a slit at the fixing nip N where the nip formation pad 26 is situated. As shown in FIG. 6B, each lateral end of the support 27 in the longitudinal direction thereof parallel to the axial direction of the fixing belt 21 is mounted on and positioned by the belt holder 43.

As shown in FIGS. 6A and 6B, a slip ring 44 is interposed between a lateral end face of the fixing belt 21 and an inward face of the belt holder 43 disposed opposite the lateral end face of the fixing belt 21 in the axial direction thereof. The slip ring 44 serves as a protector that protects the lateral end of the fixing belt 21 in the axial direction thereof. For example, even if the fixing belt 21 is skewed in the axial direction thereof, the slip ring 44 prevents the lateral end face of the fixing belt 21 from coming into direct contact with the inward face of the belt holder 43, thus preventing abrasion and breakage of the lateral end of the fixing belt 21 in the axial direction thereof. Since an inner diameter of the slip ring 44 is sufficiently greater than an outer diameter of the belt holder 43, the slip ring 44 is loosely fitted on the belt holder 43. Hence, if the lateral end face of the fixing belt 21 contacts the slip ring 44, the slip ring 44 rotates in accordance with rotation of the fixing belt 21. Alternatively, the slip ring 44 may be stationary and therefore may not rotate in accordance with rotation of the fixing belt 21. The slip ring 44 is made of heat-resistant, super engineering plastics such as PEEK, PPS, and PAI.

A heat shield is interposed between the halogen heater 23 and the fixing belt 21 at each lateral end of the fixing belt 21 in the axial direction thereof. The heat shield shields the fixing belt 21 from the halogen heater 23. For example, even if a plurality of small recording media P is conveyed through the fixing nip N continuously, the heat shield prevents heat from the halogen heater 23 from being conducted to each lateral end of the fixing belt 21 in the axial direction thereof where the small recording media P are not conveyed. Accordingly, each lateral end of the fixing belt 21 does not overheat even in the absence of large recording media P that draw heat therefrom. Consequently, the heat shield prevents thermal degradation and damage of the fixing belt 21.

A detailed description is now given of a construction of the support 27.

As shown in FIG. 4, the support 27 is constructed of a base 27*a* and two arms 27*b*. The base 27*a* contacts the nip formation pad 26 and extends vertically in FIG. 4 in the recording medium conveyance direction A1. The arms 27*b* extend from an upstream end and a downstream end of the base 27*a* in the recording medium conveyance direction A1, respectively, leftward in FIG. 4 in a pressurization direction A2 of the pressure roller 24 in which the pressure roller 24 exerts pressure to the nip formation pad 26. A tip of each arm 27*b* is situated in proximity to the inner circumferential surface of the fixing belt 21 with an interval provided between each arm 27*b* and the fixing belt 21 in the pressurization direction A2 of the pressure roller 24. According to this example embodiment, an interval d is secured between the reflector 29 mounted on the tip of each arm 27*b* and the fixing belt 21 to prevent the reflector 29 from coming into contact with the fixing belt 21.

The tip of each arm 27*b* situated in proximity to the inner circumferential surface of the fixing belt 21 allows each arm 27*b* to project long from the base 27*a* in the pressurization direction A2 of the pressure roller 24. The arms 27*b* projecting from the base 27*a* in the pressurization direction A2 of the pressure roller 24 elongate a cross-sectional area of the support 27 in the pressurization direction A2 of the pressure roller 24, increasing the section modulus and the mechanical strength of the support 27.

The nip formation pad 26 is compact, allowing the support 27 to extend as long as possible inside the loop formed by the fixing belt 21. For example, the length of the nip formation pad 26 is smaller than that of the support 27 in the recording medium conveyance direction A1. As shown in FIG. 4, the nip formation pad 26 is constructed of a center portion 26*c*, an upstream portion 26*a* disposed upstream from the center portion 26*c* in the recording medium conveyance direction A1, and a downstream portion 26*b* disposed downstream from the center portion 26*c* in the recording medium conveyance direction A1. That is, the center portion 26*c* defines a portion of the nip formation pad 26 other than the upstream portion 26*a* and the downstream portion 26*b*. A height h1 defines a height of the upstream portion 26*a* in the pressurization direction A2 of the pressure roller 24 from a hypothetical extension E of the fixing nip N extending in the recording medium conveyance direction A1. A height h2 defines a height of the downstream portion 26*b* in the pressurization direction A2 of the pressure roller 24 from the fixing nip N. A height h3 defines a maximum height of the center portion 26*c* in the pressurization direction A2 of the pressure roller 24 from the fixing nip N or the hypothetical extension E. The height h3 is not smaller than the heights h1 and h2.

Hence, the upstream portion 26*a* and the downstream portion 26*h* of the nip formation pad 26 are not interposed between the inner circumferential surface of the fixing belt 21 and the arms 27*b* of the support 27 in the pressurization direction A2 of the pressure roller 24. Accordingly, the arms 27*b* of the support 27 are situated in proximity to the inner circumferential surface of the fixing belt 21. Consequently, the support 27 having an increased size that enhances the mechanical strength thereof is accommodated in the limited space inside the loop formed by the fixing belt 21.

The halogen heater 23 is housed by the arms 27*b* of the support 27 such that the halogen heater 23 is situated above a lower hypothetical extension L1 defining an inner face of the lower arm 27*b* and below an upper hypothetical extension L2 defining an inner face of the upper arm 27*b*. Thus, the halogen heater 23 and the support 27 are accommodated inside the fixing belt 21 compactly.

The halogen heater 23 may be housed by the support 27 partially or entirely. Accordingly, the support 27 concentrates light radiated from the halogen heater 23 on a given span on the fixing belt 21. For example, a close circumferential span of the fixing belt 21 in proximity to the halogen heater 23 is heated to an increased temperature. Conversely, a distanced circumferential span of the fixing belt 21 away from the halogen heater 23 is heated to a decreased temperature. To address this circumstance, the halogen heater 23 is housed by the support 27 such that the support 27 concentrates light radiated from the halogen heater 23 on a circumferential span on the fixing belt 21 spaced apart from the halogen heater 23 with a substantially even interval therebetween, thus suppressing variation in the temperature of the fixing belt 21 heated by the halogen heater 23 and thereby improving quality of the toner image T formed on the recording medium P.

Figure 7A:
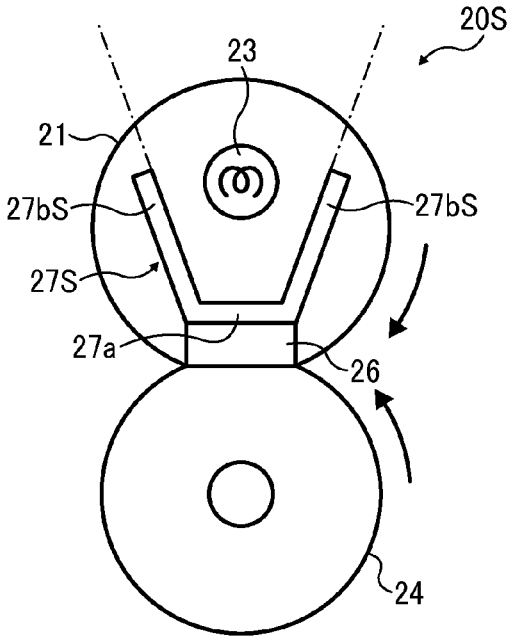
FIG. 7A is a vertical sectional view of a fixing device according to another example embodiment that incorporates a support as a first variation.
Figure 7B:
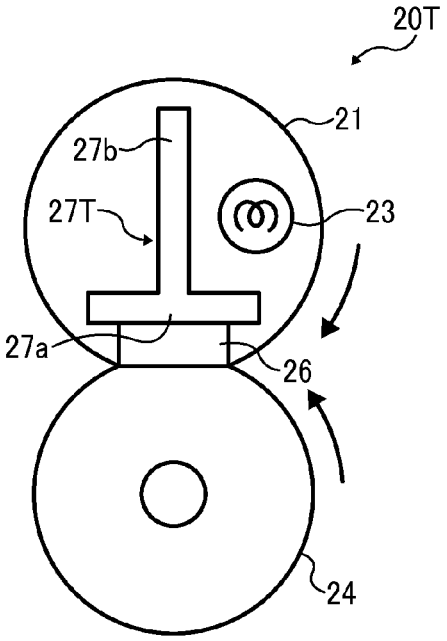
FIG. 7B is a vertical sectional view of a fixing device according to yet another example embodiment that incorporates a support as a second variation.

With reference to FIGS. 7A and 7B, a description is provided of two variations of the support 27.

FIG. 7A is a vertical sectional view of a fixing device 20S incorporating a support 27S as a first variation. FIG. 7B is a vertical sectional view of a fixing device 20T incorporating a support 27T as a second variation. The support 27 shown in FIG. 4 incorporates the arms 27*b* substantially perpendicular to the base 27*a*. Alternatively, as shown in FIG. 7A, the support 27S may include arms 27*b*S angled relative to the base 27*a*. As shown in FIG. 7B, the support 27T includes the single arm 27*b*. It is to be noted that the support 27 may have variations other than the first and second variations shown in FIGS. 7A and 7B.

Figure 8:
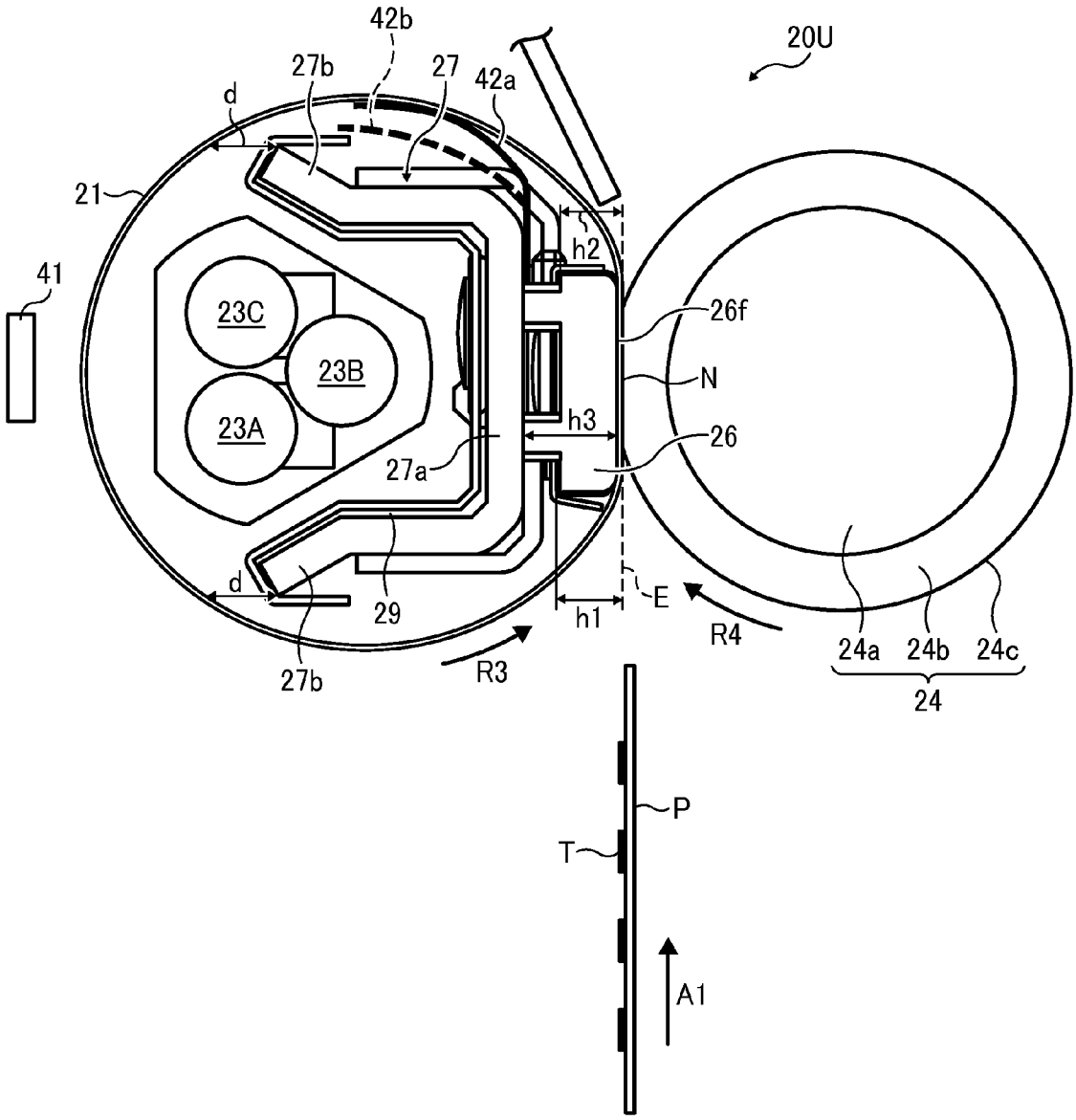
FIG. 8 is a vertical sectional view of a fixing device according to yet another example embodiment.

With reference to FIG. 8, a description is provided of a configuration of a fixing device 20U according to another example embodiment.

FIG. 8 is a vertical sectional view of the fixing device 20U. The fixing device 20 shown in FIG. 4 incorporates the single halogen heater 23 serving as a heater that heats the fixing belt 21. Conversely, the fixing device 20U incorporates three halogen heaters 23A, 23B, and 23C serving as a heater that heats the fixing belt 21 so as to correspond to recording media P of various sizes. The halogen heaters 23A, 23B, and 23C have axial heating spans spanning in the axial direction of the fixing belt 21 that are different from each other, respectively. The different axial heating spans correspond to various widths of recording media P in the axial direction of the fixing belt 21, suppressing overheating of the fixing belt 21 and saving energy. It is to be noted that the identical reference numerals are assigned to the identical components of the fixing device 20 depicted in FIG. 4 and the fixing device 20U depicted in FIG. 8. The same goes for the heights h1, h2, and h3 of the nip formation pad 26 and therefore a description of the relation between the heights h1, h2, and h3 of the nip formation pad 26 of the fixing device 20U is omitted.

Figure 9:
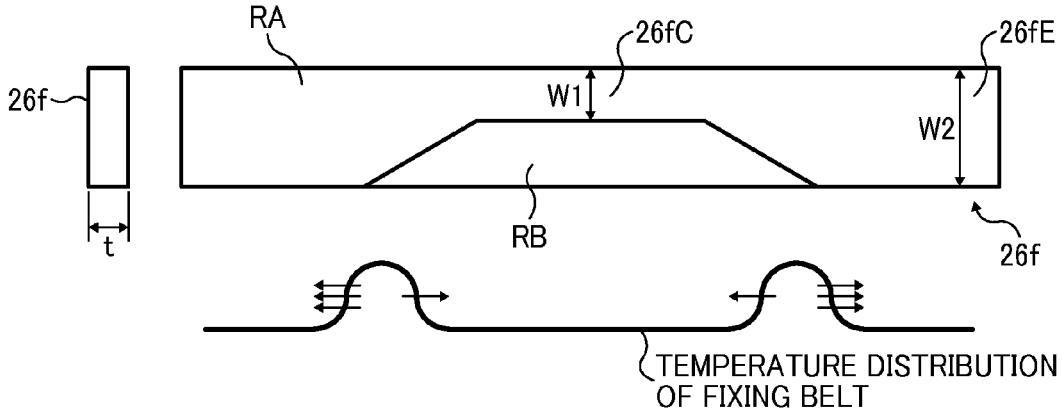
FIG. 9 illustrates a side view of a nip face of a nip formation pad incorporated in the fixing device shown in FIG. 4 and a plan view of the nip face of the nip formation pad and temperature distribution of the fixing belt.

With reference to FIG. 9, a detailed description is now given of a configuration of the nip face 26*f* of the nip formation pad 26.

FIG. 9 illustrates a side view of the nip face 26*f* and a plan view of the nip face 26*f* of the nip formation pad 26 and temperature distribution of the fixing belt 21 in a longitudinal direction of the nip face 26*f* parallel to the axial direction of the fixing belt 21. As shown in FIG. 9, a thickness t defines the thickness of the nip face 29*f* of the nip formation pad 26. The nip face 26*f* over which the fixing belt 21 slides is constructed of a first region RA made of a material A and a second region RB made of a material B. A thermal conductivity of the material A is greater than that of the material B. Since the recording medium P is conveyed over a center of the nip formation pad 26 in the longitudinal direction thereof via the fixing belt 21 and draws heat from the center of the nip formation pad 26, the center of the nip formation pad 26 is less subject to overheating compared to lateral ends of the nip formation pad 26 in the longitudinal direction thereof.

Accordingly, the first region RA made of the conductive material A has various widths in a direction perpendicular to the longitudinal direction of the nip face 26*f* parallel to the axial direction of the fixing belt 21, which vary in the longitudinal direction of the nip formation pad 26: a center width W1 and a lateral end width W2 greater than the center width W1. For example, the nip face 26*f* is constructed of a center portion 26*f*C having the center width W1 and lateral end portions 26*f*E having the lateral end width W2 greater than the center width W1. Since the lateral end portions 26*f*E of the first region RA of the nip face 26*f* have the lateral end width W2 greater than the center width W1 of the center portion 26*f*C of the first region RA of the nip face 26*f*, a thermal conductance of the lateral end portions 26*f*E is greater than that of the center portion 26*f*C, achieving enhanced heat conduction in the longitudinal direction of the nip face 26*f*, for example, facilitating heat conduction from the center portion 26*f*C to the lateral end portions 26*f*E. Accordingly, even if the lateral ends of the fixing belt 21 in the axial direction thereof over which the recording medium P is not conveyed overheat, heat dissipates from the lateral end portions 26*f*E of the nip face 26*f* of the nip formation pad 26 that correspond to the lateral ends of the fixing belt 21 effectively.

The thermal conductance, indicated with the unit of $W/m^2 \cdot K$, defines an amount of heat that moves in a unit area per unit time for a temperature difference of 1 degree centigrade between two solid bodies, representing how readily heat conducts. When λ represents a thermal conductivity and L represents a length of the nip face 26*f* in a heat conduction direction, a thermal conductance C is indicated by a following formula (1).

$$C=\lambda/L \quad (1)$$

FIG. 9 illustrates the nip face 26*f* constructed of the two materials A and B. Alternatively, the nip face 26*f* may be constructed of three or more materials by adding one or more materials having different thermal conductivities to arbitrarily control an amount of heat moving in the longitudinal direction of the nip face 26*f*. Further, the nip face 26*f* shown in FIG. 9 has two widths in a direction perpendicular to the longitudinal direction of the nip face 26*f* parallel to the axial direction of the fixing belt 21, that is, the center width W1 and the lateral end width W2. Alternatively, the center portion 26*f*C and the lateral end portions 26*f*E of the nip face 26*f* may be complex to attain a desired amount of heat conduction so as to precisely suppress overheating of the lateral ends of the fixing belt 21 in the axial direction thereof where the recording medium P is not conveyed as shown in FIG. 10 illustrating a first variation of the nip face 26*f*.

Figure 10:
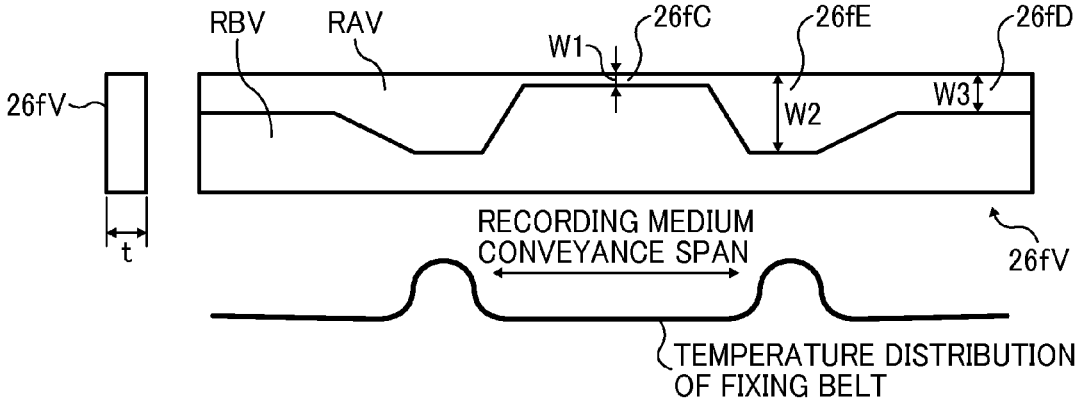
FIG. 10 illustrates a side view of a nip face of the nip formation pad incorporated in the fixing device shown in FIG. 4 as a first variation and a plan view of the nip face of the nip formation pad and temperature distribution of the fixing belt.

FIG. 10 illustrates a side view of a nip face 26*f*V and a plan view of the nip face 26*f*V and temperature distribution of the fixing belt 21 in a longitudinal direction of the nip face 26*f*V parallel to the axial direction of the fixing belt 21. As shown in FIG. 10, the nip face 26*f*V is constructed of a first region RAV made of the material A and a second region RBV made of the material B. The first region RAV has three different widths in a direction perpendicular to the longitudinal direction of the nip face 26*f*V parallel to the axial direction of the fixing belt 21. For example, the first region RAV is constructed of the center portion 26*f*C having the center width W1 and the lateral end portions 26*f*E having the lateral end width W2 greater than the center width W1. Each lateral end portion 26*f*E includes a lateral edge portion 26*f*D having a lateral edge width W3 greater than the center width W1 and smaller than the lateral end width W2. The lateral end width W2 and the lateral edge width W3 of each lateral end portion 26*f*E of the first region RAV of the nip face 26*f*V that corresponds to each lateral end of the fixing belt 21 in the axial direction thereof where the fixing belt 21 is subject to overheating are greater than the center width W1 of the center portion 26*f*C of the first region RAV of the nip face 26*f*V that corresponds to the center of the fixing belt 21 in the axial direction thereof, that is, a recording medium conveyance span of the fixing belt 21 where the recording medium P is conveyed over the fixing belt 21, thus increasing thermal conductance of each lateral end portion 26*f*E of the first region RAV of the nip face 26*f*V.

Figure 11:
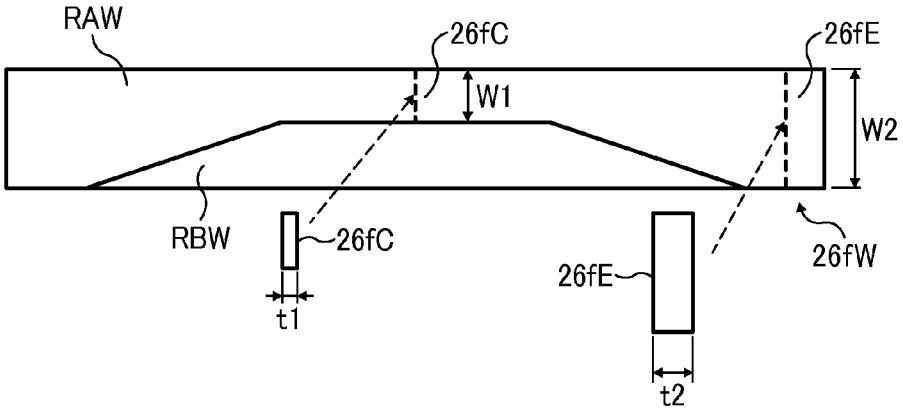
FIG. 11 illustrates a plan view of a nip face of the nip formation pad incorporated in the fixing device shown in FIG. 4 as a second variation and a side view of the nip face of the nip formation pad.

With reference to FIG. 11, a description is provided of a configuration of a nip face 26*f*W as a second variation of the nip face 26*f*.

FIG. 11 illustrates a plan view of the nip face 26*f*W and a side view of the nip face 26*f*W. As shown in FIG. 11, a center thickness t1 of the center portion 26*f*C of the nip face 26*f*W in a longitudinal direction thereof parallel to the axial direction of the fixing belt 21 is smaller than a lateral end thickness t2 of each lateral end portion 26*f*E of the nip face 26*f*W in the longitudinal direction thereof. The nip face 26*f*W over which the recording medium P slides is constructed of a first region RAW made of the material A and a second region RBW made of the second material B. A thermal conductivity of the material A is greater than that of the material B. The lateral end width W2 of each lateral end portion 26*f*E of the first region RAW of the nip face 26*f*W is greater than the center width W1 of the center portion 26*f*C of the first region RAW of the nip face 26*f*W. Accordingly, a thermal conductance of each lateral end portion 26*f*E of the nip face 26*f*W in the longitudinal direction thereof is greater than that of the center portion 26*f*C of the nip face 26*f*W in the longitudinal direction thereof.

Additionally, since the lateral end thickness t2 of each lateral end portion 26*f*E of the nip face 26*f*W is greater than the center thickness t1 of the center portion 26*f*C of the nip face 26*f*W, the thermal conductance of each lateral end portion 26*f*E of the nip face 26*f*W in the longitudinal direction thereof is further greater than that of the center portion 26*f*C of the nip face 26*f*W in the longitudinal direction thereof, thus facilitating conduction of heat on the nip face 26*f*W in the longitudinal direction thereof.

Further, the nip face 26*f*W shown in FIG. 11 has two thicknesses, that is, the center thickness t1 and the lateral end thickness t2. Alternatively, the center portion 26*f*C and the lateral end portions 26*f*E of the nip face 26*f*W may be complex to attain a desired amount of heat conduction so as to precisely suppress overheating of the lateral ends of the fixing belt 21 in the axial direction thereof where the recording medium P is not conveyed as shown in FIG. 12 illustrating a third variation of the nip face 26*f*.

Figure 12:
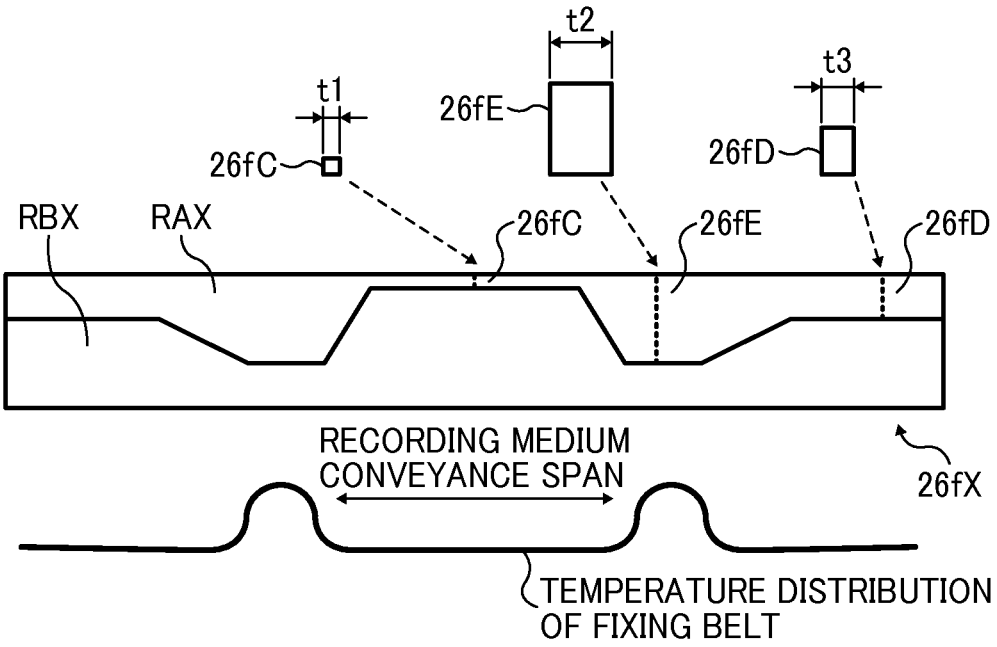
FIG. 12 illustrates a plan view of a nip face of the nip formation pad incorporated in the fixing device shown in FIG. 4 as a third variation and temperature distribution of the fixing belt.

FIG. 12 illustrates a plan view of a nip face 26*f*X and temperature distribution of the fixing belt 21 as the third variation of the nip face 26*f*. As shown in FIG. 12, the nip face 26*f*X is constructed of a first region RAX made of the material A and a second region RBX made of the material B. The first region RAX has three different thicknesses. For example, the first region RAX is constructed of the center portion 26*f*C having the center thickness t1 and the lateral end portion 26*f*E having the lateral end thickness t2 greater than the center thickness t1. The lateral end portion 26*f*E includes the lateral edge portion 26*f*D having a lateral edge thickness t3 greater than the center thickness t1 and smaller than the lateral end thickness t2. The lateral end thickness t2 and the lateral edge thickness t3 of each lateral end portion 26*f*E of the first region RAX of the nip face 26*f*X that corresponds to each lateral end of the fixing belt 21 in the axial direction thereof where the fixing belt 21 is subject to overheating are greater than the center thickness t1 of the center portion 26*f*C of the first region RAX of the nip face 26*f*X that corresponds to the center of the fixing belt 21 in the axial direction thereof, that is, the recording medium conveyance span of the fixing belt 21 where the recording medium P is conveyed over the fixing belt 21, thus increasing thermal conductance of each lateral end portion 26*f*E of the first region RAX of the nip face 26*f*X.

Figure 13:
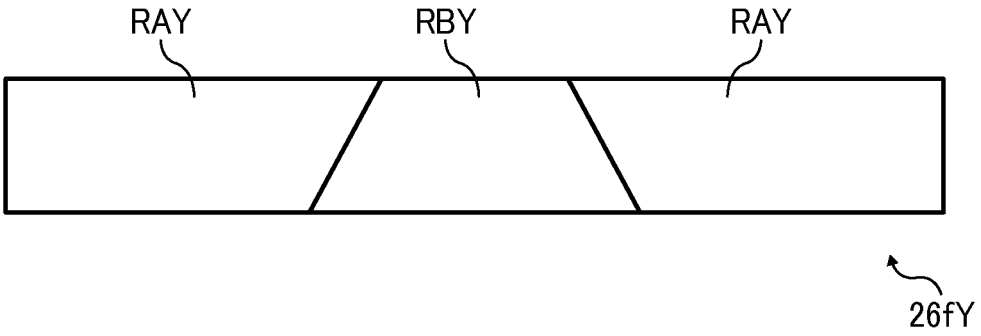
FIG. 13 is a plan view of a nip face of the nip formation pad incorporated in the fixing device shown in FIG. 4 as a fourth variation.

With reference to FIG. 13, a description is provided of a configuration of a nip face 26*f*Y as a fourth variation of the nip face 26*f*.

FIG. 13 is a plan view of the nip face 26*f*Y. As shown in FIG. 13, the nip face 26*f*Y is constructed of first regions RAY, made of the material A, disposed at both lateral ends of the nip face 26*f*Y in a longitudinal direction thereof parallel to the axial direction of the fixing belt 21 and a second region RBY, made of the material B, disposed at a center of the nip face 26*f*Y and sandwiched between the first regions RAY in the longitudinal direction of the nip face 26*f*Y. A thermal conductivity of the material A is greater than that of the material B. Accordingly, a thermal conductance of the lateral end, first regions RAY is greater than that of the center, second region RBY, facilitating conduction of heat from the center, second region RBY to the lateral end, first regions RAY. According to this example embodiment, the center, second region RBY is a single layer made of the single material B. Alternatively, the center, second region RBY may be a multilayer made of the material B and other material. Similarly, the lateral end, first region RAY may be a single layer made of the single material A or a multilayer made of the material A and other material. If the lateral end, first region RAY is multilayer, a surface layer contacting the fixing belt 21 may be made of the material A and an underlayer disposed opposite the fixing belt 21 via the surface layer may be made of a material having a thermal conductivity smaller than that of the material A, thus suppressing conduction of heat from the lateral end, first region RAY to the center, second region RBY.

Figure 14:
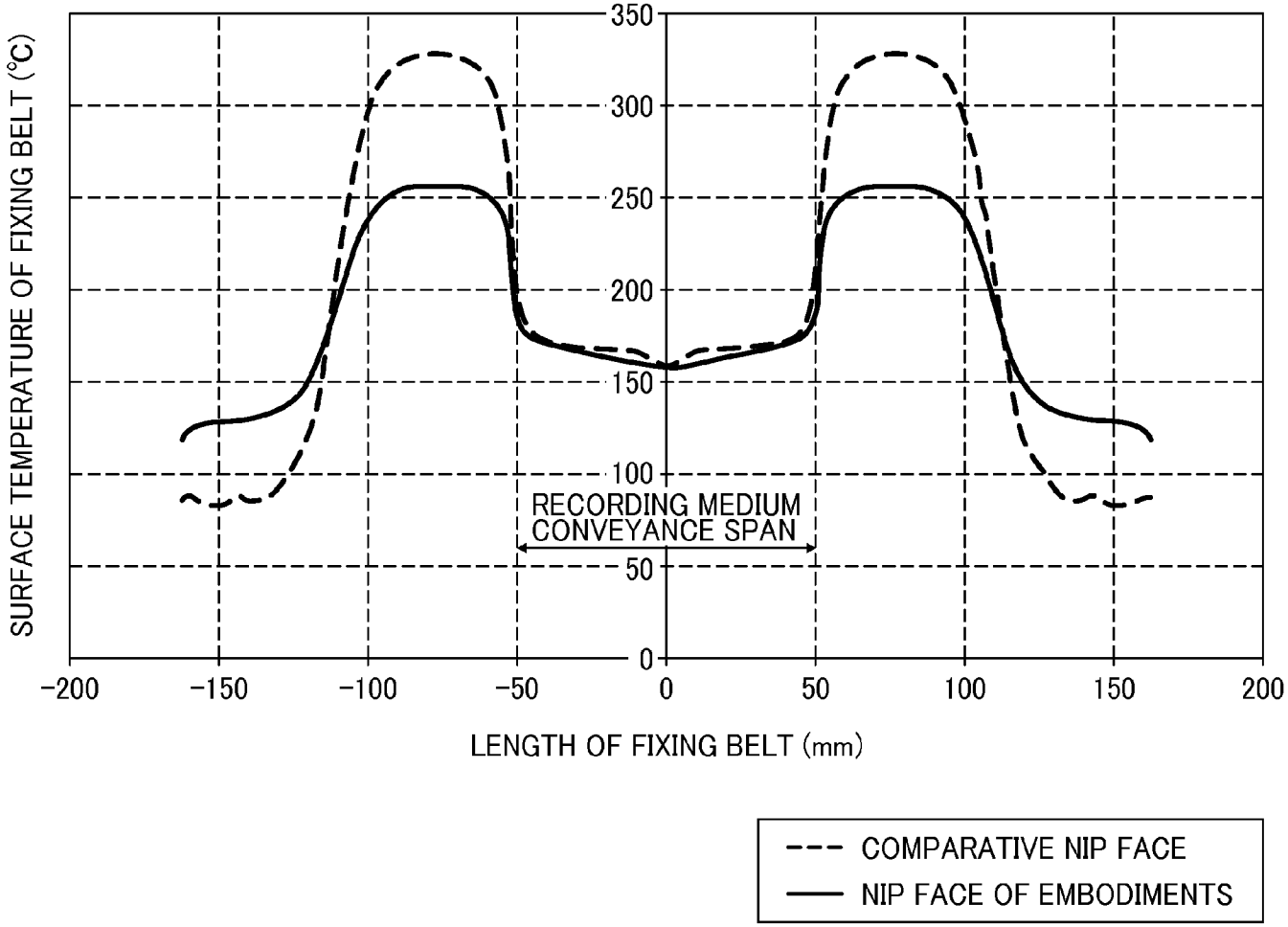
FIG. 14 is a graph showing a relation between the length of the fixing belt incorporated in the fixing device shown in FIG. 4 from a center point in the axial direction thereof and the surface temperature of the fixing belt.

With reference to FIG. 14, a description is provided of evaluation of the nip faces 26*f*, 26*f*V, 26*f*W, 26*f*X, and 26*f*Y in comparison with a comparative nip face not constructed of the materials A and B having different thermal conductivities, respectively.

FIG. 14 is a graph showing a relation between the length of the fixing belt 21 from a center point in the axial direction thereof and the surface temperature of the fixing belt 21. As shown in FIG. 14, with the comparative nip face indicated by the dotted line, the surface temperature of a non-conveyance span of the fixing belt 21 increases excessively, that is, the lateral ends of the fixing belt 21 in the axial direction thereof where the recording medium P is not conveyed overheat. Conversely, with the nip faces 26*f*, 26*f*V, 26*f*W, 26*f*X, and 26*f*Y according to the example embodiments described above, the surface of the non-conveyance span of the fixing belt 21 is heated to a decreased temperature. Accordingly, it is not necessary to suppress overheating of the non-conveyance span of the fixing belt 21 by degrading productivity of the fixing devices 20, 20S, 20T, and 20U, enhancing productivity compared to the comparative nip face.

With reference to FIGS. 4, 7A, 7B, and 8 to 13, a description is provided of advantages of the fixing devices 20, 20S, 20T, and 20U.

The fixing devices 20, 20S, 20T, and 20U include the fixing belt 21 serving as an endless belt and the pressure roller 24 serving as a pressing rotary body contacting the outer circumferential surface of the fixing belt 21. The nip formation pad 26 is disposed inside the fixing belt 21 and presses against the pressure roller 24 via the fixing belt 21 to form the fixing nip N between the fixing belt 21 and the pressure roller 24. The halogen heater 23 serves as a heater to heat the fixing belt 21. The nip formation pad 26 includes a nip face (e.g., the nip faces 26*f*, 26*f*V, 26*f*W, 26*f*X, and 26*f*Y) disposed opposite the fixing belt 21 and including a plurality of regions made of materials having different thermal conductivities, respectively, to facilitate conduction of heat to both lateral ends of the fixing belt 21 in the axial direction thereof. For example, the nip face includes the first region (e.g., the first regions RA, RAV, RAW, RAX, and RAY) having an increased thermal conductivity and the second region (e.g., the second regions RB, RBV, RBW, RBX, and RBY) having a decreased thermal conductivity and being adjacent to the first region in the axial direction of the fixing belt 21.

Accordingly, the nip face of the nip formation pad 26 has different thermal conductances varying in the axial direction of the fixing belt 21, dissipating heat from both lateral ends of the fixing belt 21 in the axial direction thereof and thereby suppressing overheating of both lateral ends of the fixing belt 21, that is, the non-conveyance span of the fixing belt 21 where the recording medium P is not conveyed.

As shown in FIGS. 9 to 13, the first region (e.g., the first regions RA, RAV, RAW, RAX, and RAY) and the second region (e.g., the second regions RB, RBV, RBW, RBX, and RBY) of the nip face (e.g., the nip faces 26*f*, 26*f*V, 26*f*W, 26*f*X, and 26*f*Y) are arranged symmetrically with respect to a center of the nip face in the longitudinal direction thereof. Alternatively, the first region and the second region may not be symmetric and therefore the lateral end portion 26*f*E of the first region may be disposed at one lateral end of the nip face in the longitudinal direction thereof. In this case, the recording medium P is conveyed over the fixing belt 21 along one lateral edge of the fixing belt 21 in the axial direction thereof.

According to the example embodiments described above, the fixing belt 21 serves as an endless belt. Alternatively, an endless film or the like may be used as an endless belt.

Further, the pressure roller 24 serves as a pressing rotary body. Alternatively, a pressing belt or the like may be used as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an endless belt;

a heater disposed opposite the endless belt to heat the endless belt;

a pressing rotary body contacting an outer circumferential surface of the endless belt; and a nip formation pad to press against the pressing rotary body via the endless belt to form a fixing nip between the endless belt and the pressing rotary body, the fixing nip through which a recording medium is conveyed, the nip formation pad including:

a nip face disposed opposite the endless belt and including:

a first region having a first thermal conductivity; and a second region having a second thermal conductivity and being adjacent to the first region in an axial direction of the endless belt, wherein the first thermal conductivity is higher than the second thermal conductivity.

2. The fixing device according to claim 1, wherein the first region of the nip face of the nip formation pad is disposed at each lateral end of the nip face in a longitudinal direction thereof parallel to the axial direction of the endless belt and the second region of the nip face of the nip formation pad is disposed at a center of the nip face in the longitudinal direction thereof to facilitate conduction of heat to the first region.

3. The fixing device according to claim 1, wherein the first region of the nip face of the nip formation pad includes:

a center portion disposed at a center of the nip face in a longitudinal direction thereof parallel to the axial direction of the endless belt and having a decreased center width in a direction perpendicular to the longitudinal direction of the nip face; and a lateral end portion disposed at each lateral end of the nip face in the longitudinal direction thereof and having an increased lateral end width in the direction perpendicular to the longitudinal direction of the nip face.

4. The fixing device according to claim 3, wherein a thermal conductance of the lateral end portion of the first region of the nip face is greater than a thermal conductance of the center portion of the first region of the nip face.

5. The fixing device according to claim 3, wherein the lateral end portion of the first region of the nip face includes a lateral edge portion disposed in proximity to a lateral edge of the nip face in the longitudinal direction thereof and having a lateral edge width greater than the center width and smaller than the lateral end width.

6. The fixing device according to claim 3, wherein the center portion of the first region of the nip face has a decreased center thickness and the lateral end portion of the first region of the nip face has an increased lateral end thickness.

7. The fixing device according to claim 6, wherein a thermal conductance of the lateral end portion of the first region of the nip face is greater than a thermal conductance of the center portion of the first region of the nip face.

8. The fixing device according to claim 6, wherein the lateral end portion of the first region of the nip face includes a lateral edge portion disposed in proximity to a lateral edge of the nip face in the longitudinal direction thereof and having a lateral edge thickness greater than the center thickness and smaller than the lateral end thickness.

9. The fixing device according to claim 3, wherein the center portion of the first region of the nip face is disposed opposite a conveyance span of the endless belt where the recording medium is conveyed that spans in the axial direction of the endless belt.

10. The fixing device according to claim 1, wherein the first region of the nip face of the nip formation pad is made of a material having an increased thermal conductivity and the second region of the nip face of the nip formation pad is made of a material having a decreased thermal conductivity.

11. The fixing device according to claim 1, further comprising a slide sheet sandwiched between the endless belt and the nip formation pad.

12. The fixing device according to claim 11, wherein the slide sheet is a low-friction sheet.

13. The fixing device according to claim 1, wherein the pressing rotary body includes a pressure roller.

14. An image forming apparatus comprising the fixing device according to claim 1.

15. The fixing device according to claim 1, wherein the heater heats the endless belt with light radiated from the heater.

* * * * *